US005826282A

United States Patent [19]

Matsumoto et al.

[11] Patent Number: 5,826,282

[45] Date of Patent: Oct. 27, 1998

[54] SANITARY CLEANING APPARATUS

[75] Inventors: Tomohide Matsumoto, Yamatotakada; Hiroaki Yonekubo, Soraku-gun; Hiroaki Yoshida, Yamatokoriyama, all of Japan

[73] Assignee: Matsushita Electric Industrial Co., Ltd., Osaka-fu, Japan

[21] Appl. No.: 844,902

[22] Filed: Apr. 22, 1997

Related U.S. Application Data

[63] Continuation of Ser. No. 502,435, Jul. 14, 1995, abandoned, which is a continuation of Ser. No. 207,728, Mar. 9, 1994, abandoned.

[51] Int. Cl.[6] ..... A47K 4/00

[52] U.S. Cl. ..... 4/420.4; 4/420.2; 239/543

[58] Field of Search ..... 4/420.1–420.5, 4/447, 448; 239/543

[56] References Cited

U.S. PATENT DOCUMENTS

| | | | |
|---|---|---|---|
| 541,310 | 6/1895 | Broadwell | 239/543 |
| 4,761,837 | 8/1988 | Takeda | 4/443 |
| 5,025,511 | 6/1991 | Takeda et al. | 4/447 |

FOREIGN PATENT DOCUMENTS

| | | | |
|---|---|---|---|
| 2297295 | 6/1976 | France . | |
| 2334791 | 8/1977 | France . | |
| 58-13688 | 3/1983 | Japan . | |
| 62-111038 | 5/1987 | Japan . | |
| 63-152703 | 6/1988 | Japan . | |
| 0318623 | 12/1989 | Japan | 4/447 |
| 1-318624 | 12/1989 | Japan . | |
| 0108736 | 4/1990 | Japan | 4/448 |
| 2136441 | 5/1990 | Japan | 4/420.4 |
| 0144430 | 6/1990 | Japan | 4/420.4 |
| 3017324 | 1/1991 | Japan | 4/420.4 |
| 3257231 | 11/1991 | Japan | 4/420.4 |
| 3281840 | 12/1991 | Japan | 4/448 |
| 5118072 | 5/1993 | Japan | 4/420.4 |

OTHER PUBLICATIONS

English language translation of JP 3,257,231.
English language translation of JP 0,318,623.
Abstract of JP 2–136441, May 25, 1990, 1 pg.
Abstract of JP 2–80725, Mar. 20, 1990, 1 pg.
Abstract of JP 1–318624, Dec. 25, 1989, 1 pg.

*Primary Examiner*—Robert M. Fetsuga
*Attorney, Agent, or Firm*—Wenderoth, Lind & Ponack, L.L.P.

[57] ABSTRACT

A sanitary cleaning apparatus includes a plurality of cleaning water jetting openings on a nozzle, and the axes of those jetting openings intersect with each other between a jetting surface of the nozzles and a region to be cleaned. The sanitary cleaning apparatus provides various cleaning patterns by giving turbulence to the jetting flow, by mixing air in the water, and by changing distribution ratio of jetting flows from different jetting openings.

11 Claims, 14 Drawing Sheets

SANITARY CLEANING APPARATUS

This application is a continuation of now abandoned application Ser. No. 08/502,435, filed Jul. 14, 1995, which is a Continuation of now abandoned application Ser. No. 08/207,728, filed on Mar. 9, 1994.

BACKGROUND OF THE INVENTION

1. Field of the Invention

The present invention relates to a sanitary cleaning apparatus for cleaning the private parts after defecating and more particularly to a sanitary cleaning apparatus which effectively cleans the private parts by changing the flow state of cleaning water and allows a user to select a desired pattern of cleaning jet flow.

2. Description of the Prior Art

In some conventional sanitary cleaning apparatuses for cleaning the private parts, one nozzle or a plurality of nozzles are used to jet hot water to the private parts. The cleaning water jetted from the nozzle or nozzles is in the form of a convergent steady flow. Therefore, a user feels uncomfortable when the cleaning water collides with the private parts.

In order to overcome this problem, a sanitary cleaning apparatus was proposed and disclosed in examined Japanese Patent Publication No. 58-13688. The apparatus is intended to generate a jet flow which gives a soft feeling to a user by bubbles contained in the cleaning water. The apparatus comprises an ejector nozzle, disposed in the vicinity of a jet opening of a nozzle, for increasing the flow speed of the cleaning water; and an air sucking portion for sucking air from a negative pressure space generated by a high-speed flow of the cleaning water jetted from the nozzle and containing air in the cleaning water. That is, the apparatus is intended to give a soft feeling to the user by the cleaning water containing air jetted from the jet opening during the cleaning operation. But the cleaning water does not fluctuate in its flow over the region to be cleaned. Hence, the cleaning efficiency has yet to be improved. Excrement attached to the region to be cleaned is washed away therefrom by the process in which the cleaning water penetrates into a portion between the region to be cleaned and the excrement, thus reducing the connection therebetween and the process in which the cleaning water collides with the region to be cleaned, thus separating the excrement from the region to be cleaned. The excrement can be effectively separated from the region to be cleaned by moving jet flows on the region to be cleaned fluctuantly and widely. Although the sanitary cleaning apparatus used by the above apparatus contains air therein, it uses convergent jet flow and thus it is impossible to clean the region to be cleaned widely in conformity to the configuration of the region to be cleaned. The construction of the apparatus necessitates the movement of the entire nozzle device in order to clean the region to be cleaned efficiently and widely. Hence, a particular driving means is essential and thus the apparatus is complicated in construction and large, which leads to a high cost.

According to a sanitary cleaning apparatus disclosed in Japanese Laid-Open Patent Publication No. 63-152703, cleaning water is fluctuated to give a comfortable feeling to a user and clean the region to be cleaned efficiently. The sanitary cleaning apparatus is shown in FIGS. 1 and 2. The sanitary cleaning apparatus is mounted on a stool 1 having a seat 3 and a cover 4. The sanitary cleaning apparatus comprises a main body 5 accommodating the cleaning apparatus; and a nozzle 7 which is projected into the stool 1 to clean the private parts of a user 6. The nozzle 7 shown in FIG. 2 comprises a contraction portion 8 communicating with a liquid supply path 9; a jetting opening 10 interposed between walls 11 and 12; and swirl chambers 13 and 14 disposed on both sides of the direction of a jet flow and having openings 15 and 16 communicating with atmospheric air, respectively.

In the above construction, when cleaning water which has flowed into the nozzle 7 from the main body 5 is jetted from the contraction portion 8 via the liquid supply path 9, the cleaning water flows out from the jetting opening 10 with the cleaning water in contact with the wall 11 in the direction shown by an arrow (A) due to Coanda effect, and air is sucked from the opening 15 and as a result, a bubble-containing eddy is generated in the swirl chamber 13. At the same time, the pressure of the swirl chamber 13 increases due to the air-suction, with the result that the direction of the jet flow is changed to the direction shown by an arrow (B). While the cleaning water is jetted in this manner, a self-oscillation state is generated, with the result that the fluctuating cleaning water is jetted toward the private parts. Because the cleaning water moves fluctuantly over the region to be cleaned, excretion can be washed away from the private parts efficiently and the cleaning water is jetted widely toward the private parts. Further, because air is contained in the cleaning water, the user has a soft feeling during cleaning.

The sanitary cleaning apparatus is intended to generate a stable oscillation by utilizing the pressure difference between the two swirl chambers disposed on both sides of the direction of the jet flow. Therefore, in a low flow rate region, the flow speed of the cleaning water jetted from the contraction portion 8 is reduced and hence it is difficult to obtain the pressure difference reliably. In addition, a slight change in sizes of constituent members or in the supply state of the cleaning water cause bubbles to be contained in the cleaning water at a nonuniform ratio. Hence, oscillation becomes unstable in the low flow rate region.

Needless to say, the sanitary cleaning apparatus is utilized by a plurality of persons and thus favorable states of a jet flow are different from each other according to sex, age, seating position or the like. Therefore, there is a growing demand for the development of a sanitary cleaning apparatus allowing a user to select a pattern of jet flow in accordance with the user's desire. As a measure for complying with such a demand, a sanitary cleaning apparatus may allow a user to select the flow speed of the cleaning water to a favorable speed from among a plurality of flow speeds but the pattern of the jet flow is the same for each flow speed. Hence, the sanitary cleaning apparatus has yet to be improved.

In recent years, a sanitary cleaning apparatus as shown in FIGS. 3 and 4 has been proposed and disclosed in Japanese Laid-Open Patent Publication No. 62-111038. The sanitary cleaning apparatus comprises two cleaning nozzles or more which jet cleaning water in different flow patterns. Referring to FIGS. 3 and 4, the sanitary cleaning apparatus comprises a first anal region cleaning nozzle 17 which provides a steady jet flow stimulating the region to be cleaned in a high degree; a second anal region cleaning nozzle 18 which jets cleaning water at a lower speed than the first anal region cleaning nozzle 17 and in a wider range than the first anal region cleaning nozzle 17; a third cleaning nozzle for cleaning the female private parts; and an operation panel 20, shown in FIG. 4, comprising first, second, and third switches 21, 22, and 23 for actuating the cleaning nozzles 17, 18, and 19, respectively; a stop switch 24; a flow speed adjusting switch 25; a nozzle change-over switch 26; a pump 27; a tank 28; a hose 29; and a hot water tank 30. Upon pressing of any one of the first, second, and third switches 21, 22, and 23, any one of the cleaning nozzles 17, 18, and 19 is selected by the nozzle change-over switch 26, and the pump 27 operates to supply water in the tank 28 to the hot water tank 30 via the hose 29. Then, the water in the tank 30 is jetted from any one of the cleaning nozzles 17, 18, and 19. In this sanitary cleaning apparatus having this construction, a desirable jet pattern can be selected by selecting any one of the first, second, and third switches 21, 22, and 23, and in addition, a desired flow speed of the cleaning water can be selected by adjusting the flow speed adjusting switch 25 which controls the pump 27.

It is, however, necessary to provide the sanitary cleaning apparatus with a plurality of cleaning nozzles and the nozzle switching means. Thus, the sanitary cleaning apparatus has a complicated construction and is large and hence expensive.

SUMMARY OF THE INVENTION

It is accordingly a first object of the present invention to provide a sanitary cleaning apparatus having a simple construction and providing stable fluctuant cleaning water flowing in different flow states, thus cleaning a region to be cleaned efficiently and widely even in a low flow rate region.

It is a second object of the present invention to provide a sanitary cleaning apparatus having a simple construction and allowing a user to select a desirable cleaning pattern from among a steady convergent jet flow and a dispersive jet flow to be applied to the region to be cleaned in a wider range than the steady convergent jet flow.

In accomplishing the first object of the present invention, there is provided a sanitary cleaning apparatus comprising: a cleaning water supply means; a water supply channel; and a cleaning nozzle for jetting cleaning water toward a region to be cleaned. The cleaning nozzle comprises a plurality of jetting openings capable of jetting cleaning water supplied from the cleaning water supply means. The jetting openings are inclined so that a part of axes thereof or all axes thereof which jet cleaning water intersect with each other between a jetting surface of the cleaning nozzle and the region to be cleaned. Turbulence generating means is provided to generate turbulence in the cleaning water to be discharged the jetting openings. Further, inside the nozzle, the turbulence generating means generates bubbles in the cleaning water to change the pressure of fluid and thereby change the flow speeds of jet flows discharged from the jetting openings. Further, the turbulence generating means serves as a means for altering the rate of flow jetted from each jetting opening and further, containing air in the cleaning water so as to generate turbulence in jet flows. According to this construction, the cleaning water supplied from the cleaning water supply means is jetted from the jetting openings, the jet flows intersect with each other between the jetting surface of the cleaning nozzle and the region to be cleaned. As a result, the jet flows become confluent with each other. Resolving the forces of respective jet flows at the confluent point into horizontal components and vertical components of the jet direction, the forces of the vertical components of respective jet flows are jetted in different flow states due to a jet speed, a flow rate, and the dissolution of air in the cleaning water. Thus, the vertical components of respective jet flows are unbalanced with each other and hence, the jet flows fluctuate. Merely the inclination of the jetting openings and the provision of the turbulence generating means cause jet flows to fluctuate, thus separating excrement from the region to be cleaned efficiently and cleaning the region to be cleaned widely. In addition, the range of the jet flow to be applied to the region to be cleaned, namely, a cleaning position can be easily adjusted by selecting the inclination of the jetting openings. Because jet flows are fluctuated by making them turbulent in order to change the vertical components of the forces of the jet flows in different flow states, a slight change in dimension and in the supply state of the cleaning water do not affect the fluctuant state of the cleaning water even in a low flow rate.

In order to achieve the second object, there is provided a sanitary cleaning apparatus comprising: a cleaning water supply means; a water supply channel; a nozzle comprising a plurality of jetting openings inclined by a predetermined angle and jetting the cleaning water toward the region to be cleaned so that a part of axes of the jetting openings or all axes thereof intersect with each other between a jetting surface of the cleaning nozzle and the region to be cleaned; air containing means for containing air in the cleaning water; air dissolution selection switch for selecting or rejecting the dissolution of air in the cleaning water; and air amount adjusting means for controlling the air containing means based on a signal outputted from the air dissolution selection switch.

According to this construction, a user is allowed to select a desirable cleaning pattern from among a steady convergent jet flow and a dispersive jet flow to be applied to the region to be cleaned in a wider range than the steady convergent jet flow by selecting the air dissolution selection switch. That is, supposing that air is not contained in the cleaning water, when the cleaning water which has been supplied from the cleaning water supply means is jetted from the jetting openings, jet flows intersect with each other between the jetting surface of the nozzle and the region to be cleaned. As a result, the jet flows are in contact and confluent with each other at the intersection. Resolving the forces of respective jet flows at the confluent point into horizontal components and vertical components of the jet direction, the vertical components are balanced with each other. In this manner, the cleaning water is jetted toward the region to be cleaned in the form of a steady convergent flow. When air is contained in the cleaning water, jet flows discharged from the jetting openings are different from each other in flow state and thus the vertical components of respective jet flows are unbalanced with each other and hence, the jet flows fluctuate. Merely the control over the mixture of air with the cleaning water allows the user to select the desirable cleaning pattern from among the steady convergent jet flow and the dispersive jet flow to be applied to the region to be cleaned in a wider range than the steady convergent jet flow. Accordingly, the user can select a desirable jet flow from among the above two kinds of jet flows without using a dedicated nozzle or a switching means. In addition, air can be contained in the cleaning water in a wide range. That is, air can be contained in the cleaning water anywhere in the supply system of the cleaning water and thus, a remote control can be performed easily in selecting a desired jet flow. Further, the present invention provides a cleaning pattern in which a convergent cleaning and a wide range cleaning alternate with each other. Therefore, the flow speed of the cleaning water fluctuates, and the cleaning water is jetted to the region to be cleaned convergently and dispersively, which washes excretion away from the anal region reliably. Thus, the anal region can be cleaned efficiently. Further, this way of cleaning does not give the feeling of monotonousness to the user.

A sanitary cleaning apparatus comprises a first duct and a second duct; a plurality of jetting openings communicating with each of the first duct and the second duct; and flow amount ratio adjusting means for controlling the distribution ratio of the amount of the cleaning water to be supplied to the first duct and the second duct. The axes of the first duct and that of the second duct intersect with each other between a jetting surface of the cleaning nozzle and a region to be cleaned.

According to this construction, the user can be allowed to select a desirable cleaning pattern from among the steady convergent jet flow and the dispersive jet flow to be applied to the region to be cleaned in a wider range than the steady convergent jet flow by controlling the distribution ratio. That is, if the ratio of the flow amount to be jetted from the first jetting opening to the flow amount to be jetted from the second jetting opening is controlled to be 1:1, jet flows intersect with each other at a predetermined position and become confluent with each other. Resolving the forces of respective jet flows at the confluent point into horizontal components and vertical components of the jet direction, the vertical components are balanced with each other. In this manner, the cleaning water is jetted toward the region to be cleaned in the form of a steady convergent flow. If the ratio of the flow amount to be jetted from the second jetting opening is set to be more than the flow amount to be jetted from the first jetting opening, the vertical components are unbalanced with each other. As a result, the jet force from the second jetting opening increases while the jet force from the first jetting opening decreases. Consequently, jet flows which have been confluent with each other are jetted toward the region to be cleaned on the first jetting opening side. That is, it is possible to change the cleaning position by altering the distribution ratio of the cleaning water to be supplied to the first and second jetting openings. Accordingly, the user can be allowed to select a desirable cleaning pattern from among the steady convergent jet flow and the dispersive jet flow to be applied to the region to be cleaned in a wider range than the steady convergent jet flow by merely controlling the distribution ratio. Furthermore, because the direction of the jet flow can be changed without moving the nozzle, excrement can be separated from the region to be cleaned with a high efficiency and the cleaning apparatus has a simple construction. In addition, the user can change the direction of the jet flow as desired by controlling stepwise the distribution ratio of the cleaning water. That is, the cleaning position can be adjusted without moving the nozzle.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
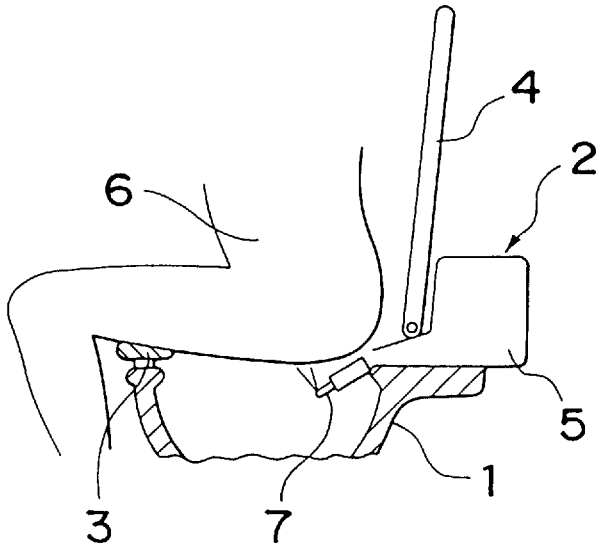
Fig. 1 PRIOR ART
FIG. 1 is a view showing a stool seat equipped with a first conventional sanitary cleaning apparatus.
Figure 2:
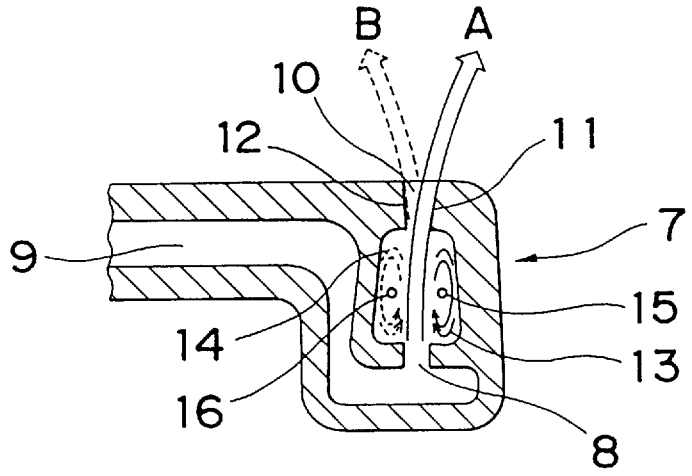
Fig. 2 PRIOR ART
FIG. 2 is a partial sectional view showing a cleaning nozzle of the sanitary cleaning apparatus of FIG. 1.
Figure 3:
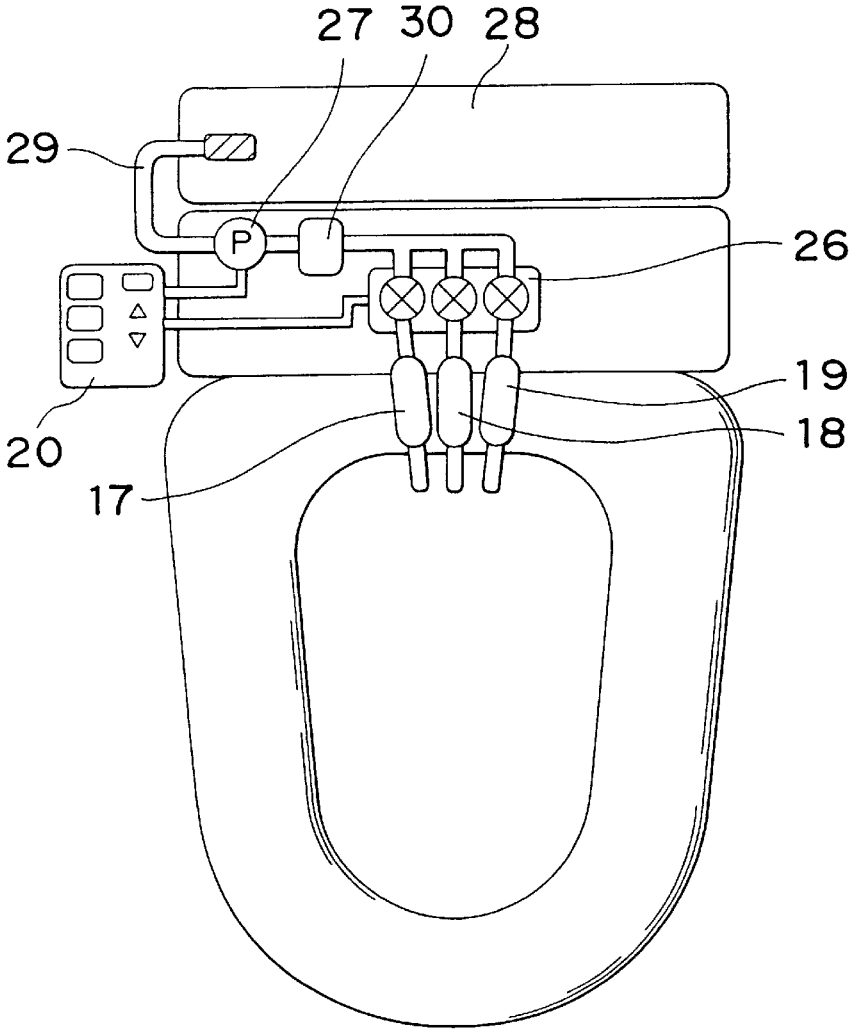
Fig. 3 PRIOR ART
FIG. 3 is a view showing a second conventional sanitary cleaning apparatus.
Figure 4:
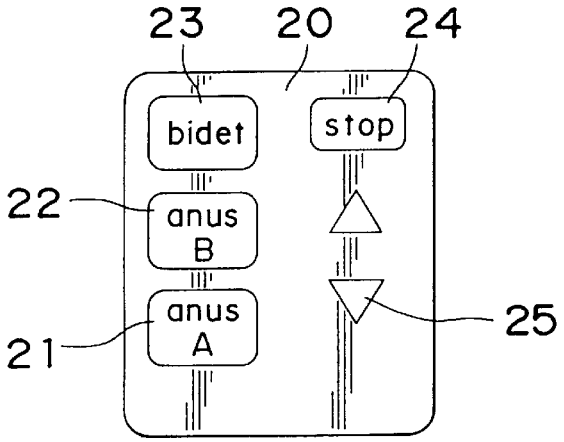
Fig. 4 PRIOR ART
FIG. 4 is a view showing the construction of a control panel of the sanitary cleaning apparatus of FIG. 3.

Before the description of the present invention proceeds, it is to be noted that like parts are designated by like reference numerals throughout the accompanying drawings.

Figure 5:
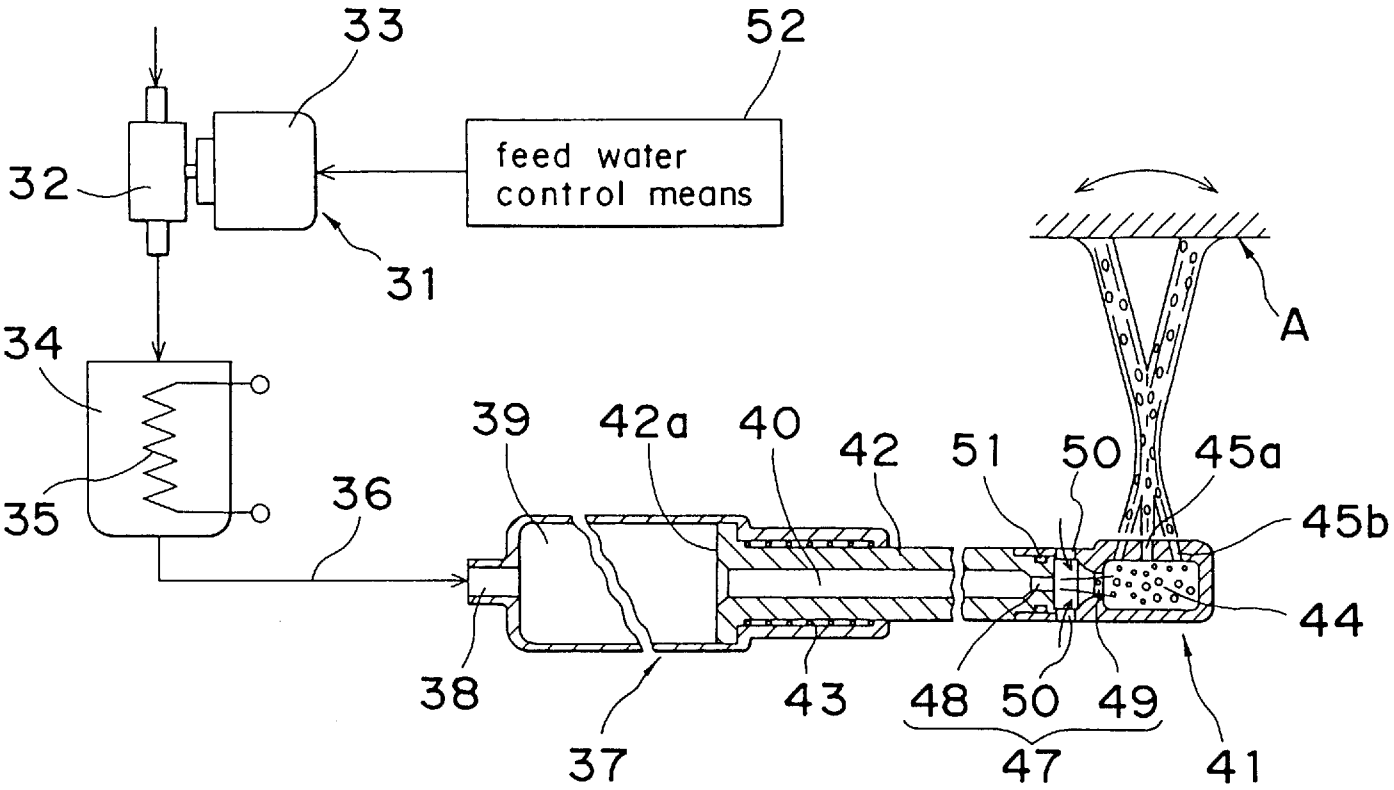
FIG. 5 is a view showing the construction of a sanitary cleaning apparatus according to a first embodiment of the present invention.
Figure 6:
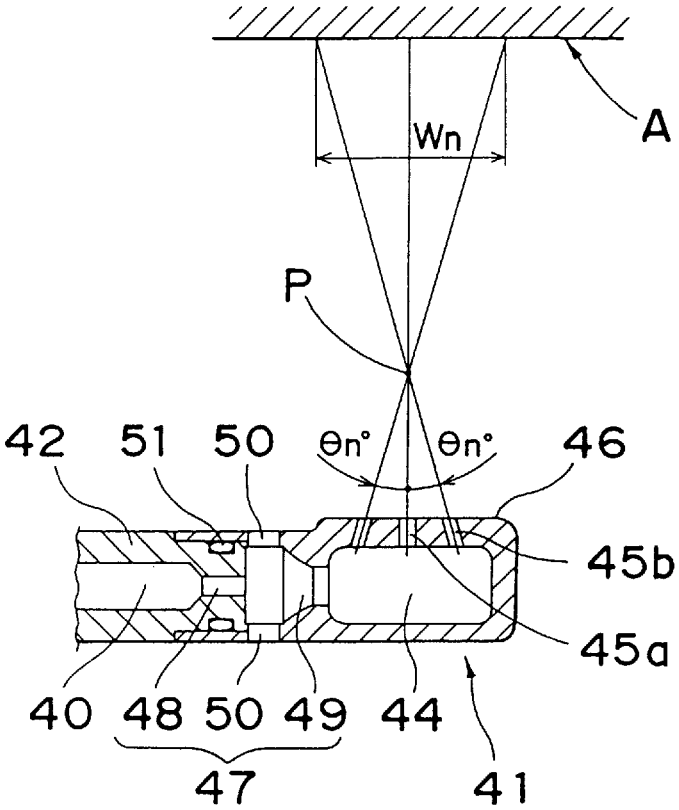
FIG. 6 is an enlarged view showing a cleaning nozzle of the sanitary cleaning apparatus of FIG. 5.
Figure 7:
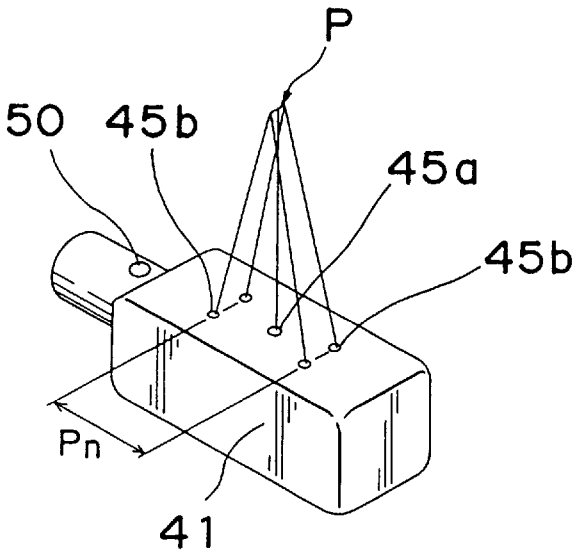
FIG. 7 is a perspective view showing the sanitary cleaning apparatus of FIG. 5.

A sanitary cleaning apparatus according to a first embodiment of the present invention is described below with reference to FIGS. 5, 6, 7, and 8. There is shown in FIG. 5 the construction of the sanitary cleaning apparatus. The sanitary cleaning apparatus comprises a cleaning water supply means (or cleaning water supply device) 31 having a water pump 32 and a motor 33 for driving the pump 32; a hot water tank 34 for storing water heated by an electric heater 35; and a water supply channel 36. A nozzle main body 37 comprises a nozzle cylinder 39 having a water supply opening 38 communicating with the water supply channel 36; a movable water supply member 42 disposed inside the nozzle cylinder 39 and driven to move forward by the water pressure of cleaning water to a position corresponding to the private parts (A), thus supplying the cleaning water fed through the water supply channel 36 to a cleaning nozzle 41 disposed at the leading end of the sanitary cleaning apparatus via a communicating path 40; and an elastic member 43 for moving the movable water supply member 42 to a backward (retracted) position when the supply of the cleaning water is stopped due to the stop of the cleaning water supply means 31. As shown in FIGS. 6 and 7, the nozzle 41 has a plurality of jetting openings 45*a* and 45*b* (i.e. a main jetting opening 45*a* and peripheral jetting openings 45*b*) for jetting the cleaning water which has flowed into a nozzle chamber 44 toward the private parts (A). The axis of each of the jetting openings 45*a* and 45*b* forms θn° with a vertical line so that the axes intersect with each other at a point (P) between the upper end surface 46 of the nozzle 41 and the private parts (A). The sanitary cleaning apparatus further comprises a turbulence generating means 47 for allowing the jetting openings 45*a* and 45*b* to jet the cleaning water in different flow states by mixing air and the cleaning water with each other. The turbulence generating means 47 comprises a contraction nozzle 48 provided at the leading end of the communicating path 40; a diffuser 49 coaxial with the contraction nozzle 48; and an air sucking opening 50 for sucking air from a negative pressure space generated by a high-speed flow of the cleaning water discharged from the contraction nozzle 48 and mixing the sucked air and the cleaning water with each other. The nozzle 41 mounted on the leading end of the movable water supply member 42 is sealed by a sealing member 51. The sanitary cleaning apparatus further comprises a water supply control means 82 for controlling the supply of the cleaning water.

Figure 8:
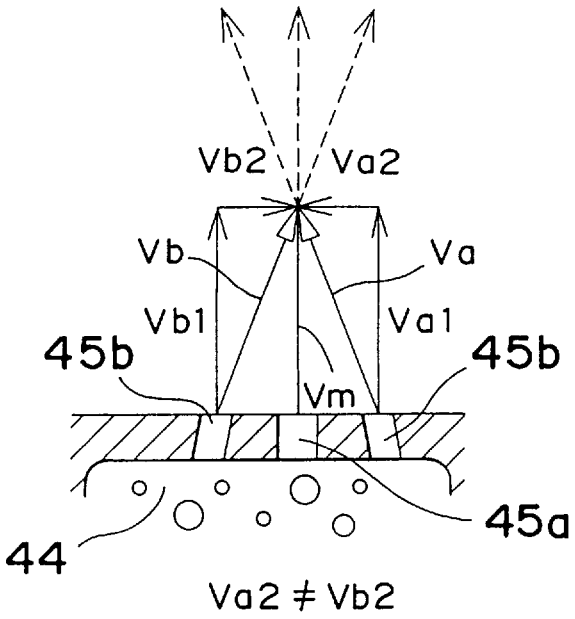
FIG. 8 illustrates the principle of a fluctuant jet flow.

The operation of the sanitary cleaning apparatus having the above-described construction is described below. When a cleaning actuation switch (not shown) provided in the water supply control means 52 is pressed, the motor 33 is driven. As a result, the cleaning water is fed by the pump 32 to the nozzle cylinder 39 from the tank 34. The pressure of the cleaning water acts on the backward end surface 42*a* of the movable water supply member 42, thus pressing the movable water supply member 42 forward against the force of the elastic member 43. The movable water supply member 42 stops at the position corresponding to the private parts so that the cleaning water is jetted from the jetting openings 45*a* and 45*b* to the private parts (A). When the cleaning water passes through the contraction nozzle 48, the flow speed of the cleaning water is increased. Air is sucked from the air sucking opening 50 provided in the negative pressure space generated by a high-speed flow of the cleaning water and dissolved in the cleaning water. The cleaning water containing air is jetted from the jetting openings 45*a* and 45*b*. Jet flows of the cleaning water become confluent in contact with each other at the point (P). At this time, the jet flows of the cleaning water are in different flow states because air is dissolved in the cleaning water by the turbulence generating means 47. Resolving the force of each jet flow at the confluent point (P) into a horizontal component and a vertical component, the forces of the vertical components of respective jet flows become unbalanced and the directions and forces of respective jet flows become differentiated from each other and thus the entire cleaning water fluctuates. Referring to FIG. 8, description is made on this point. Let it be supposed that the force of the cleaning water jetted from the jetting opening 45*a* is Vm; the forces jetted from the two inclined jetting openings 45*b* are Va and Vb; and the force Va is resolved into a horizontal component Va1 and a vertical component Va2; and the force Vb is resolved into a horizontal component Vb1 and a vertical component Vb2. In this condition, bubbles pass through the openings 45*a* and 45*b* because air is dissolved in the cleaning water. As a result, respective jet flows from the openings 45*a* and 45*b* are in different flow states. Consequently, the vertical components Va2 and Vb2 become unbalanced as shown in FIG. 8 and thus the entire cleaning water fluctuates. For example, supposing that the diameter of each of the openings 45*a* and 45*b* is 1 mm and 0.75 mm; pitch Pn is 10 mm; inclination θn is 30°; the distance between the upper end surface 46 of the nozzle 41 and the private parts (A) is 52 mm; cleaning water is jetted from the openings 45*a* and 45*b* at 0.81/min; and the amount of air dissolved in the cleaning water is 0.21/min, the fluctuant cleaning water is jetted to the private parts (A) in a length of 15 mm. It is possible to obtain a desired range Wn by adjusting the inclination θn of the opening 45*b* and the pitch Pn. That is, a great range Wn can be obtained by setting the inclination θn to a large one and the pitch Pn to a small one, whereas a small range Wn can be obtained by setting the inclination θn to a small one and the pitch Pn to a large one. Although the flow speed of the fluctuant cleaning water is comparatively high, it can be adjusted by altering the amount of the cleaning water, the diameter of bubbles, and the diameter of the jetting openings 45*a* and 45*b*.

As described above, according to the first embodiment, it is possible to fluctuate each jet flow of the cleaning water although the inclined jetting openings and the turbulence generating means 47 are of a simple construction. Consequently, the private parts (A) can be cleaned with a high efficiency and in a wide range. Further, it is possible to adjust the range Wn of the fluctuant cleaning water, namely, cleaning range by adjusting the inclination θn of the jetting opening and the pitch between the jetting openings. Each jet flow is made to be turbulent, and the force of each jet flow in the vertical direction is varied to obtain fluctuant cleaning water. Therefore, a slight change in dimension and in the supply state of the cleaning water do not affect the fluctuant state of the cleaning water even in a low flow rate.

Figure 9A:
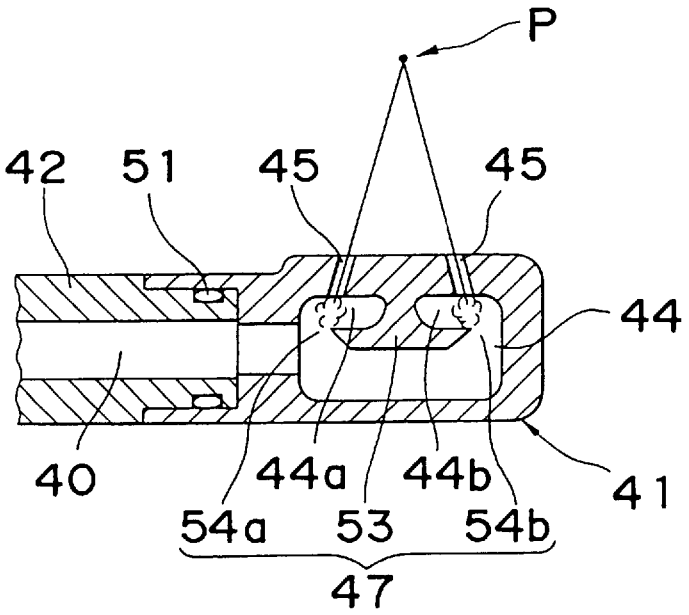
FIGS. 9A and 9B are sectional views showing principal portions of a nozzle according to modifications of the nozzle of FIGS. 5 and 6.
Figure 9B:
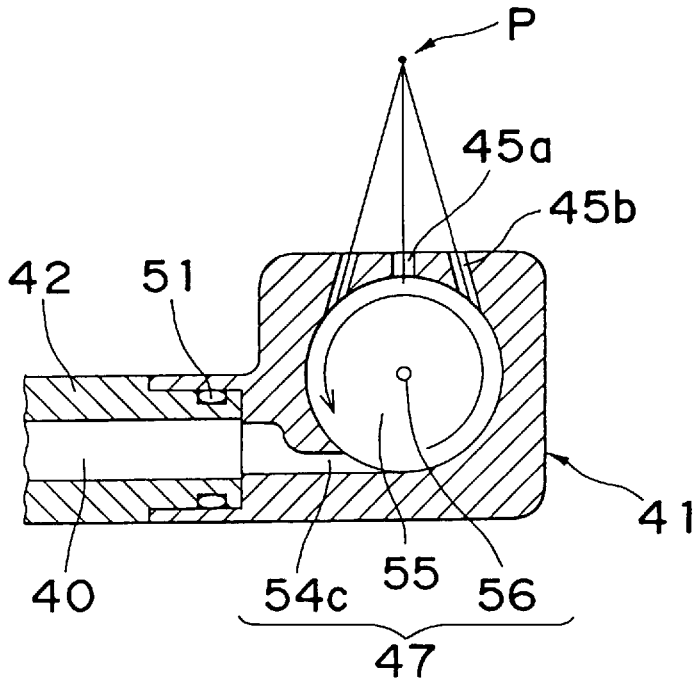

FIGS. 9A and 9B are sectional views showing the nozzle 41 according to another embodiment. Referring FIG. 9A, there is provided a bubble generating member 53, disposed in the nozzle chamber 44 communicating with the communicating path 40, for jetting the cleaning water in different flow states from the jetting openings by feeding the cleaning water to first and second nozzle chambers 44*a* and 44*b* and causing the cleaning water to generate bubbles when the cleaning water passes through contracting portions 54*a* and 54*b*. Other component parts of the nozzle 41 are similar to those shown in FIG. 6 and denoted by the same reference numerals. Therefore, the detailed descriptions thereof are omitted herein.

In this construction, the cleaning water which has flowed into the nozzle chamber 44 via the communicating path 40 is introduced into the first and second nozzle chambers 44*a* and 44*b*, and bubbles are generated in the cleaning water when the cleaning water passes through the contracting portions 54*a* and 54*b*. That is, the flow speed of the cleaning water becomes unconstant due to the generation of bubbles in the flow thereof and as a result, the pressure of the first and second nozzle chambers 44*a* and 44*b* fluctuate in the vicinity of the jetting openings 45. Consequently, the cleaning water is jetted out from each jetting opening 45 at different pressures. In this manner, the vertical components of the forces of respective jet flows are unbalanced at the confluent point (P) and thus the entire jet flow fluctuates. The nozzle 41 according to this embodiment provides an effect similar to that provided by the first embodiment and simplifies the construction of the sanitary cleaning apparatus because it is unnecessary to provide the sanitary cleaning apparatus with the contraction nozzle 48, the diffuser 49, and the air sucking opening 50.

Referring FIG. 9B, the turbulence generating means 47 comprises a contracting portion 54*c* communicating with the communicating path 40 of the movable water supply member 42; a bubble generating chamber 55, disposed downstream of the contracting portion 54*c*, for swirling the cleaning water; and an air communicating opening 56 for sucking air from eddy current generated in the bubble generating chamber 55. Other component parts of the nozzle 41 are similar to those shown in FIG. 6 and denoted by the same reference numerals. Therefore, the detailed description thereof are omitted herein.

In this construction, the cleaning water swirls when it is introduced into the bubble generating chamber 55 via the contracting portion 54*c* as shown in FIG. 9B, and the pressure in the center portion of the swirling flow becomes negative. As a result, air is sucked from the air communicating opening 56 into the bubble generating chamber 55 and dissolved in the cleaning water and the cleaning water containing air is jetted from the jetting openings 45*a* and 45*b*. Based on the principle of the embodiment shown in FIG. 6, the vertical components of respective jet flows are unbalanced at the confluent point (P) and thus the entire jet flow fluctuates. In this embodiment, the jet flow can be fluctuated reliably and in a low flow rate in particular, because the jet flow is fluctuated by both eddy current and air dissolved in the cleaning water in the bubble generating chamber 55, in addition to the effect of the above-described embodiments.

Figure 10:
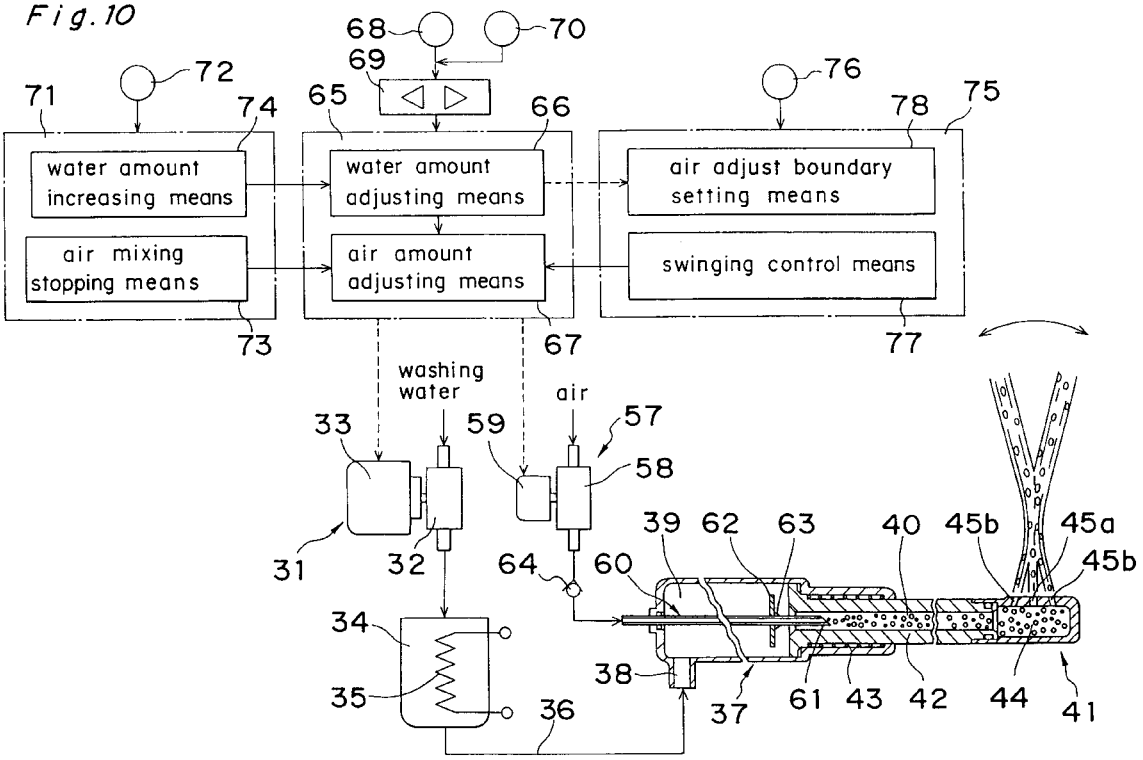
FIG. 10 is a view showing the construction of a sanitary cleaning apparatus according to a second embodiment of the present invention.

A sanitary cleaning apparatus according to a second embodiment of the present invention is described below with reference to FIG. 10. An air mixing means (or air mixing device) 57 for forcibly dissolving air in the cleaning water comprises an air pump 58 for generating compressed air; a motor 59 for driving the air pump 58; and an air supply pipe 60 for dissolving the compressed air in the cleaning water. An opening 61 of the air supply pipe 60 is coaxial with the nozzle cylinder 39 so that the air supply pipe 60 becomes disposed in the communicating path 40 when the movable water supply member 42 has moved to the forward position (cleaning position), i.e., when the nozzle 41 has moved to the position corresponding to the private parts (A). A movable plate 62 installed on the peripheral surface of the air supply pipe 60 operates in cooperation with the reciprocating motion of the movable water supply member 42 and is capable of sealing the communicating path 40. A stopper 63 for stopping the movable plate 62 at a position where the duct of the cleaning water is secured when the movable water supply member 42 has moved to the forward position (cleaning position). A check valve 64 prevents the back flow of the cleaning water from the air supply pipe 60 to the air pump 58.

A first water supply control circuit 65 for controlling the supply of the cleaning water comprises a water amount adjusting means 66 for controlling the water pump 32 and an air amount adjusting means 67 for controlling the air pump 58. When a switch 68 is pressed, a predetermined amount of cleaning water and air are supplied to the nozzle 41. When a flow speed adjusting switch 69 is pressed, the water pump 32 and the air pump 58 are controlled so that a desired flow speed is selected depending on a user. When a stop switch 70 is turned on, the water feeding operation terminates. A second water supply control circuit 71 comprises an air mixing stopping means 73 for stopping the air pump 58 upon pressing of a first jet flow selection switch 72; and a water amount increasing means 74 for increasing the cleaning water by a predetermined amount. A third water supply control circuit 75 comprises a swinging control means 77 for altering the amount of air to be dissolved in the cleaning water in a predetermined cycle by controlling the air pump 58 upon pressing of a second jet flow selection switch 76; and an air adjust boundary setting means 78 for setting the upper and lower limits of air amount according to a water flow speed selected by the flow speed adjusting switch 69. Other component parts of the nozzle 41 are similar to those shown in FIGS. 5 and 6 and denoted by the same reference numerals. Therefore, the detailed descriptions thereof are omitted herein.

The operation of the sanitary cleaning apparatus having the above-described construction is described below.

When the switch 68 is pressed after defecation, the rotation of the motors 33 and 59 is started by the first water supply control circuit 65, and the water pump 32 supplies a predetermined amount of cleaning water into the cylinder 39 via the tank 34 and the water supply opening 38. Then, the pressure of the cleaning water acts on the end surface of the movable water supply member 42, thus moving the movable water supply member 42 forward against the force of the elastic member 43. At this time, the water pressure presses the movable plate 62, slidably mounted on the peripheral surface of the air supply pipe 60 and sealing the communicating path 40, forward toward the nozzle 41 together with the movable water supply member 42. When the nozzle 41 has reached the position corresponding to the private parts (A), the movable plate 62 is stopped in contact with the stopper 63, thus flowing the cleaning water through the opened communicating path 40. Simultaneously with the actuation of the water pump 32, the air pump 58 is actuated, and thus air fed through the air supply pipe 60 and discharged from the opening 61 of the air supply pipe 60 is dissolved in the cleaning water at a predetermined ratio. Then, the cleaning water containing bubbles flows into the nozzle 41. Because air is dissolved in the cleaning water in the vicinity of the nozzle 41, the area of the cleaning water does not rapidly enlarge or contract after the air is dissolved in the cleaning water. Thus, bubbles are prevented from being connected with each other and hence diameters of bubbles can be prevented from becoming nonuniform. That is, bubbles having a uniform diameter can be supplied to the nozzle chamber 44. In addition, the flow speed of the cleaning water passing through the vicinity of the opening 61 is increased due to the reduction of the area of the cleaning water, and the pressure of the opening 61 can be reduced by ejector effect caused by the passage of the cleaning water. Thus, air can be dissolved in the cleaning water at a low pressure. Accordingly, air can be forcibly dissolved in the cleaning water by the air pump 58 having a low discharge pressure.

The cleaning water containing air which has flowed into the nozzle chamber 44 is jetted from the jetting openings 45*a* and 45*b* (i.e. from the main jetting opening 45*a* and the peripheral jetting openings 45*b*), thus fluctuating based on the principle of the above-described embodiment of FIG. 5. The user has a soft feeling during the use of the sanitary cleaning apparatus because bubbles have been contained in the cleaning water and in addition, has the private parts (A) cleaned with efficiency due to the fluctuation of the cleaning water. Further, the cleaning water is widely jetted to the private parts (A). The disconnection of bubbles prevents the bubble diameters from being enlarged and bubbles having a uniform diameter can be supplied to the nozzle chamber 44. Therefore, noise is generated in a small degree when the cleaning water is jetted from the jetting openings 45*a* and 45*b*.

Figure 11:
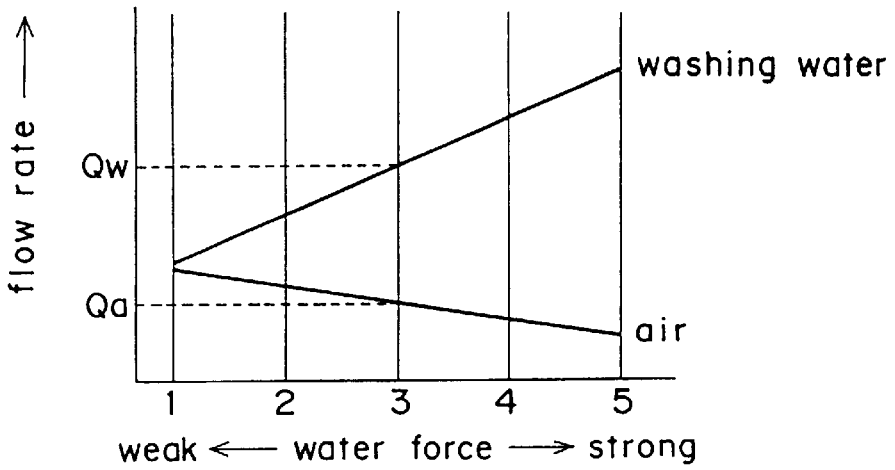
FIG. 11 is a characteristic view showing the relationship between the flow speed of cleaning water and the amount of the cleaning water as well as that of air

Operation of adjusting the flow speed of the cleaning water is described below. The flow speed of the cleaning water, namely, the amount of the cleaning water to be jetted from the nozzle 41 can be adjusted depending on a user's desire by pressing the flow speed adjusting switch 69 after the switch 68 is turned on. FIG. 11 is a characteristic view showing the relationship between the flow speed of the cleaning water and the amount of the cleaning water as well as that of air. In this embodiment, the flow speed can be adjusted in five stages. Immediately after cleaning operation starts, i.e., immediately after the switch 68 is pressed, level 3 which is an intermediate flow speed is automatically selected and cleaning water and air are supplied to the nozzle 41 in an amount of Qw and Qa, respectively. This is to eliminate the need for pressing the switch 68 many times. As shown in FIG. 11, the mixing ratio between the cleaning water and air is changed according to the flow speed of the cleaning water. This is to prevent the reduction of the absolute value of the vertical components Va2 and Vb2 of the jet force shown in FIG. 8, namely, to prevent the reduction of the range of the jet flow of the cleaning water, namely, the cleaning range. In this manner, even in a low flow rate region, the range can be made to be as wide as that of a high flow rate range.

Figure 12:
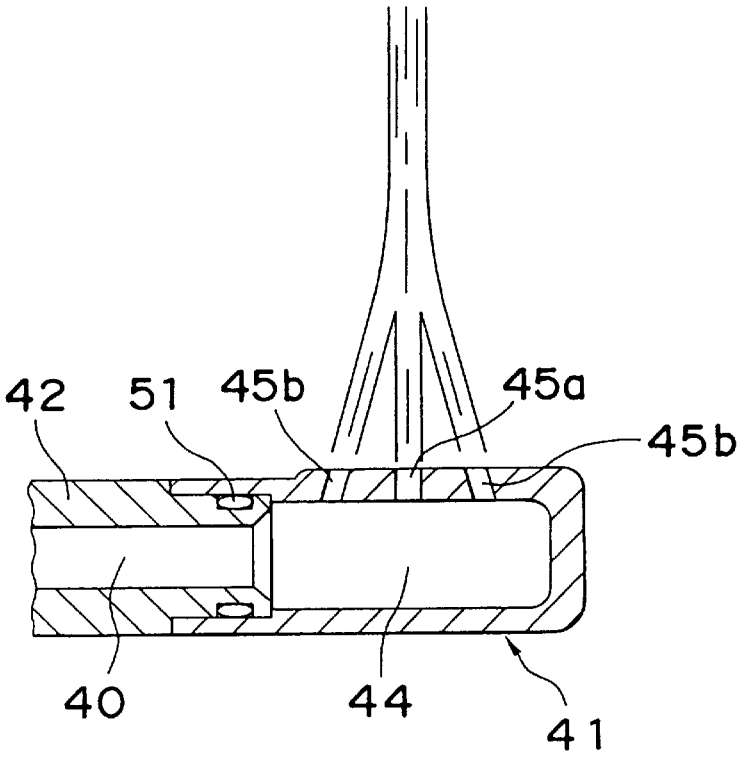
FIG. 12 is an enlarged view showing a cleaning nozzle of the sanitary cleaning apparatus of FIG. 10.
Figure 13:
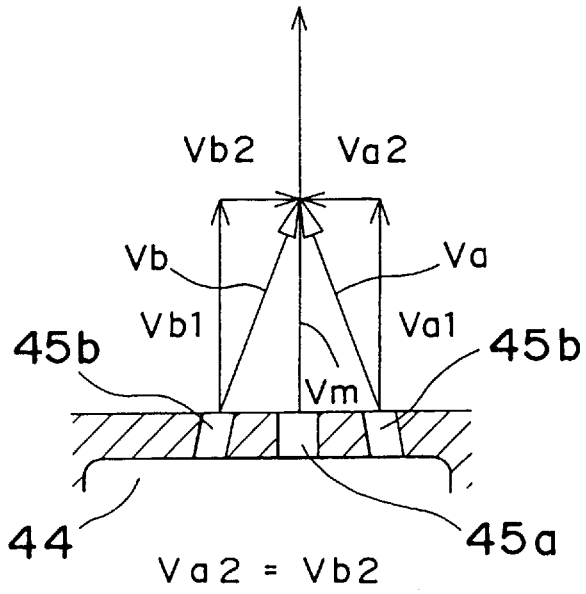
FIG. 13 illustrates the principle of a fluctuant jet flow.

The operation of the second water supply control circuit 71 is described below. When the first jet flow selection switch 72 is pressed after the switch 68 is turned on, the indication made by the flow speed adjusting switch 69 is canceled, and the air mixing stopping means 73 is actuated to stop the operation of the air pump 58, thus suspending the dissolution of air in the cleaning water. At this time, the back flow of the cleaning water via the air supply pipe 60 is prevented by the check valve 64. As a result, only the cleaning water is supplied to the nozzle 41. Jet flows from the jetting openings 45*a* and 45*b* become confluent with each other and convergent (or concentrated), thus reaching the area to be cleaned as shown in FIG. 12. Detailed description is made below on this respect with reference to FIG. 13. Supposing that the force of the cleaning water jetted from the jetting opening 45*a* is Vm; the forces jetted from the two inclined jetting openings 45*b* are Va and Vb; and the force Va is resolved into a horizontal component Va1 and a vertical component Va2; and the force Vb is resolved into a horizontal component Vb1 and a vertical component Vb2, the vertical components Va2 and Vb2 are balanced with each other because air is not dissolved in the cleaning water and thus the cleaning water becomes convergent.

Figure 14:
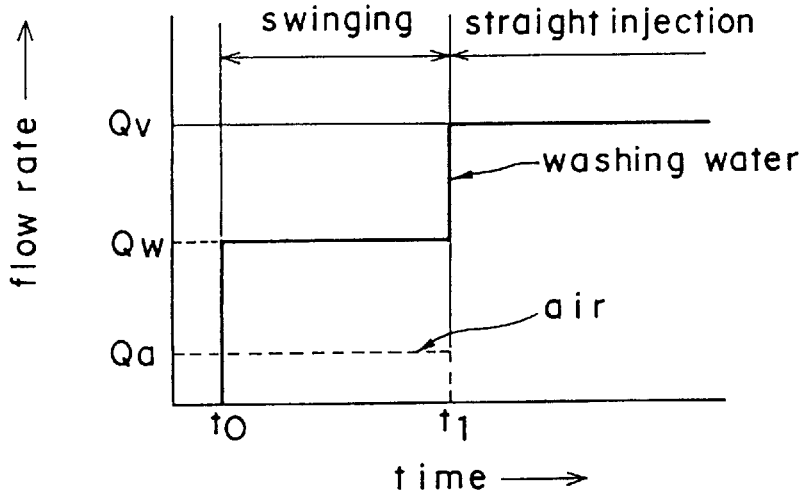
FIG. 14 is a time chart showing the relationship between time and the amount of cleaning water as well as that of air.

The water amount adjusting means 66 is controlled by the water amount increasing means 74 so as to increase the number of rotations of the water pump 32. As a result, the flow rate of the cleaning water is increased. Detailed description is made on this point with reference to FIG. 14. When the switch 68 is pressed at a time $t_0$, the water pump 32 and the air pump 58 are actuated, thus supplying the cleaning water and air in an amount of Qw and Qa, respectively. Consequently, the fluctuant cleaning water containing bubbles is jetted from the nozzle 41. When the first jet flow selection switch 72 is pressed at a time $t_1$, the supply of air is stopped and the cleaning water is increased up to a flow rate Qv. This is to prevent the user from feeling uncomfortable due to the decrease of air in the cleaning water. More specifically, in cleaning the private parts (A) by the cleaning water containing air, the rate of flow jetted from the nozzle 41 is the sum of the amount of the cleaning water and that of air. When the cleaning water is brought into contact with the private parts (A), a predetermined flow rate is set. Therefore, when the supply of air is stopped, the flow rate decreases substantially and hence the user may feel less comfortable than usual. Accordingly, when the private parts (A) are cleaned by the cleaning water not containing air, it is necessary to supply water increasingly. When a high-speed convergent jet flow collides with the anal region, the anal region is stimulated, which causes the user to have a call of nature. If the user desires to have the anal region cleaned by the cleaning water containing air, namely, the fluctuating cleaning water, the first jet flow selection switch 72 is pressed. That is, a fluctuant jet flow or a convergent jet flow can be selected by pressing the first jet flow selection switch 72.

Figure 15:
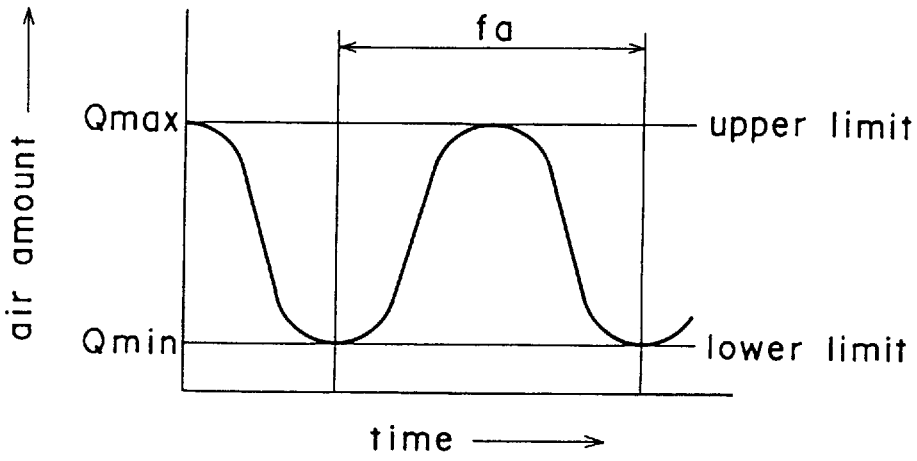
FIG. 15 is a characteristic view showing the relationship between time and the amount of air.
Figure 16:
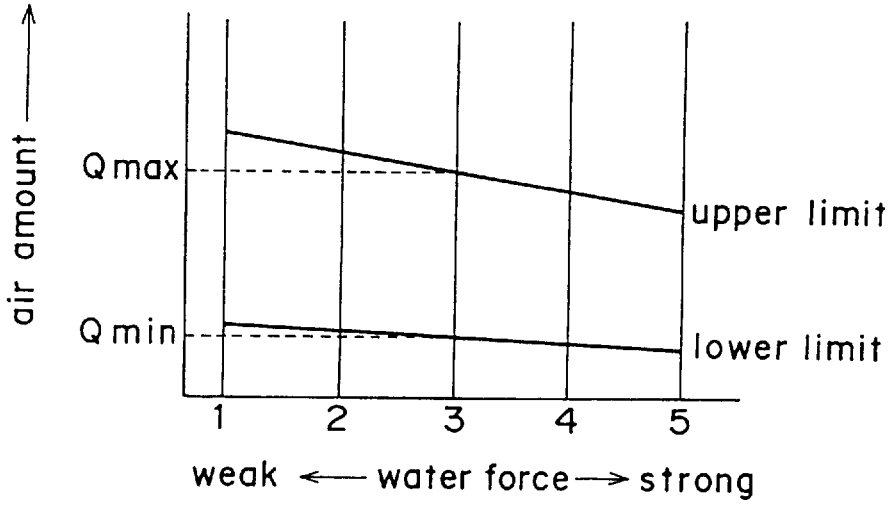
FIG. 16 is a characteristic view showing the relationship between the flow speed of cleaning water and the upper limit as well as the lower limit of the amount of air

The operation of the third water supply control circuit 75 is described below. When the second jet flow selection switch 76 is pressed after the switch 68 is turned on, the swinging control means 77 controls the air pump 58, thus increasing or decreasing the amount of air to be dissolved in the cleaning water in a range from Qmi to Qmax at a predetermined cycle (fa) as shown in FIG. 15. As a result, the fluctuating cleaning water containing air and the convergent cleaning water of a steady flow automatically alternate with each other. That is, the flow speed of the cleaning water fluctuates and the cleaning water is jetted to the area to be cleaned convergently and dispersively, which washes excretion away from the anal region reliably. Thus, the anal region can be cleaned efficiently and in addition, massaged. Further, this way of cleaning does not give the feeling of monotonousness to the user. The upper limit Qmax and the lower limit Qmin of the amount of air to be controlled by the swinging control means 77 is automatically set by the air adjust boundary setting means 78 for setting the upper and lower limits of air amount according to the flow speed selected by pressing of the flow speed adjusting switch 69. FIG. 16 is a characteristic view showing the relationship between flow speed and the upper limit Qmax as well as the lower limit Qmin of the amount of air. When flow speed level 3 is selected, an air amount is increased or decreased in the range from upper limit Qmax to the lower limit Qmin. In this manner, the user can select a flow speed depending on the user's desire. When the stop switch 70 is pressed, cleaning operation is stopped.

As described above, in this embodiment, the cleaning water comprises the nozzle 41 providing jet flows of fluctuant cleaning water containing air; the first jet flow selection switch 72 for selecting or rejecting the dissolution of air in cleaning water; and the second jet flow selection switch 76 for changing an air amount cyclically. Depending on the user's desire, the fluctuant jet flow or the convergent jet flow can be selected by pressing the first jet flow selection switch 72. When the convergent jet flow is selected, the water amount increasing means 74 for increasing the amount of the cleaning water prevents the user from feeling uncomfortable although air supply is stopped. In addition, a high-speed jet flow collides with the anal region, thus stimulating it and causing the user to have a call of nature.

The amount of air is changeably dissolved in the cleaning water by the selection of the second jet flow selection switch 76. As a result, the fluctuant cleaning water containing air and the convergent cleaning water of a steady flow automatically alternate with each other. The flow speed of the cleaning water fluctuates, and the cleaning water is jetted to the area to be cleaned convergently and dispersively, which washes excretion away from the anal region reliably. Thus, the anal region can be cleaned efficiently and in addition, massaged. In addition, an air amount is increased or decreased in the range from the upper limit Qmax to the lower limit Qmin according to a selected flow speed. In this manner, the user feels comfortable in having the anal region cleaned depending on a selected flow speed.

Further, when cleaning operation starts, i.e., when the switch 68 is pressed, not the convergent cleaning water but the fluctuant cleaning water containing air is jetted from the nozzle 41. Accordingly, the user does not feel pain. This is preferable for a victim of hemorrhoids.

Figure 17:
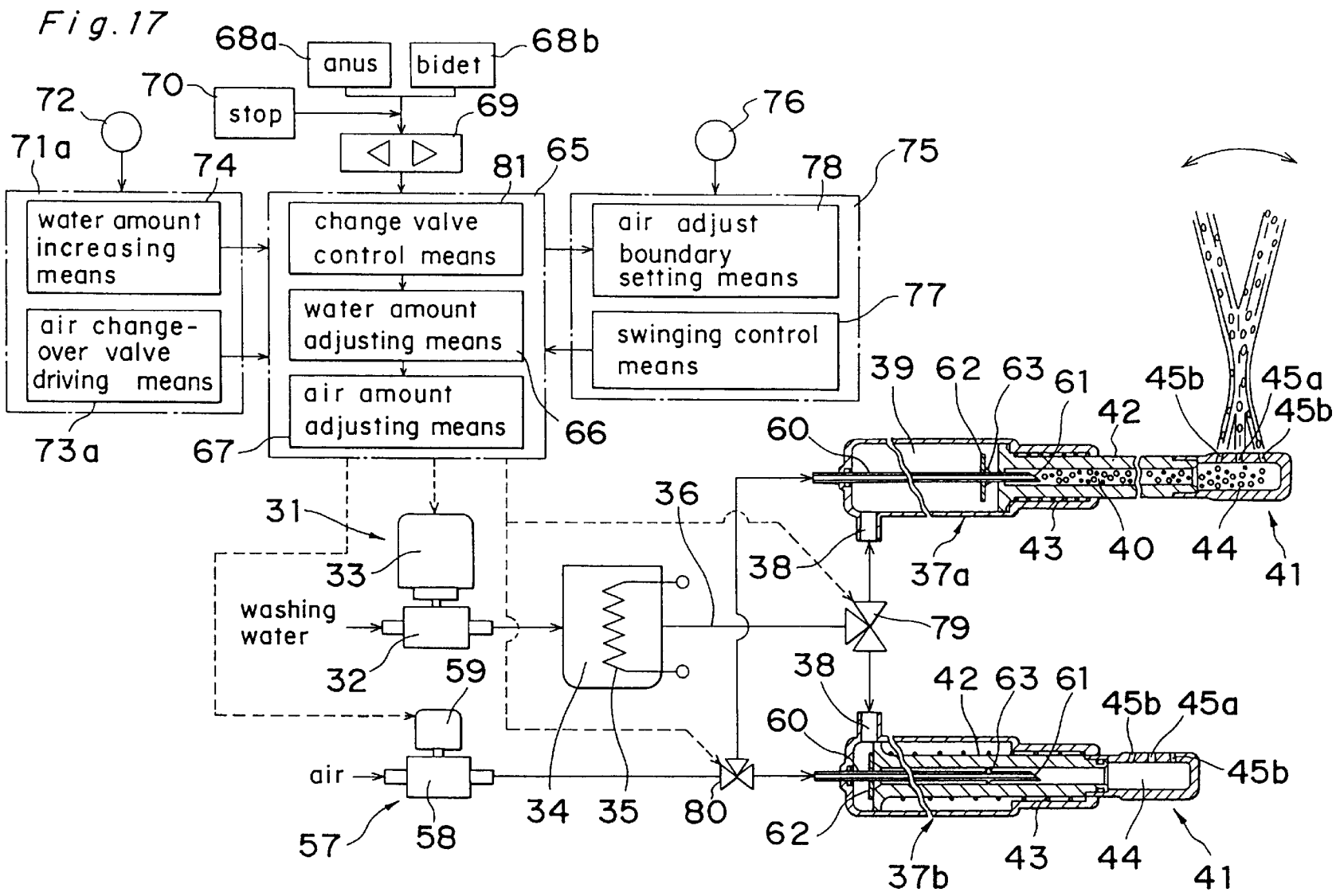
FIG. 17 is a view showing the construction of a sanitary cleaning apparatus according to a third embodiment of the present invention.

A sanitary cleaning apparatus according to a third embodiment of the present invention is described below with reference to FIG. 17. Referring to FIG. 17, the sanitary cleaning apparatus comprises an anal region cleaning nozzle 37*a* for cleaning the anal region after defecation; a cleaning nozzle 37*b* for cleaning the female private parts. Each of the anal region cleaning nozzle 37*a* and the cleaning nozzle 37*b* is composed of members similar to those of the nozzle shown in FIG. 10 and is constructed to have a jetting position, a jetting angle, and a flow rate suitable for cleaning the anal region and the female private parts. A cleaning water change-over valve 79, one end of which communicates with the cleaning water supply means 31 supplies the cleaning water supplied from the cleaning water supply means 31 to either the anal region cleaning nozzle 37*a* or the cleaning nozzle 37*b*. An air change-over valve 80, one end of which communicates with the air supply means 57 supplies air supplied from the air supply means 57 to either the anal region cleaning nozzle 37*a* or the cleaning nozzle 37*b* via the air supply pipe 60. The sanitary cleaning apparatus further comprises an anal region cleaning switch 68*a* for actuating the anal region cleaning nozzle 37*a* and a cleaning switch 68*b* for actuating the cleaning nozzle 37*b*. A change-over valve control means 81 of the first water supply control circuit 65 is operated by pressing either the anal region cleaning switch 68*a* or the cleaning switch 68*b*, and the cleaning water change-over switch 79 and the air change-over valve 80 are operated in turn, thus supplying the cleaning water and air to the nozzle 37*a* or the nozzle 37*b*. A second water supply control circuit 71*a* comprises an air change-over valve driving means 73*a* for switching the duct so as to discharge air to the nozzle 37*a* or the nozzle 37*b* by the air change-over valve 80 driven by the pressing of the first jet flow selection switch 72; and a water amount increasing means 74. Other members of the sanitary cleaning apparatus are similar to those shown in FIG. 10 and denoted by the same reference numerals. Therefore, the detailed descriptions thereof are omitted herein.

The operation of the sanitary cleaning apparatus having the above-described construction is described below. When the anal region cleaning switch 68*a* is selected after defacation, the cleaning water change-over valve 79 and the air change-over valve 80 are operated by the change-over valve control means 81 and then, the cleaning water and air are supplied to the anal region cleaning nozzle 37*a*. Then, as shown in FIG. 17, the cleaning water is jetted from the anal region cleaning nozzle 37*a* toward the anal region. When the first jet flow selection switch 72 or the second jet flow selection switch 76 is pressed, operation similar to that of the embodiment shown in FIG. 10 is performed. When the first jet flow selection switch 72 is pressed, the air change-over valve driving means 73*a* allows the air change-over valve 80 to switch the duct to the cleaning nozzle 37*b* and as a result, only air is discharged from the cleaning nozzle 37*b*.

When the cleaning switch 68*b* is selected, the cleaning water change-over valve 79 and the air change-over valve 80 supply the cleaning water and air, respectively to the cleaning nozzle 37*b* and as a result, the movable water supply member 42 is driven to move from the backward position shown in FIG. 17 to the cleaning position by water pressure. In this manner, the female private parts can be cleaned.

In the third embodiment, because the anal region cleaning nozzle 37*a* and the cleaning nozzle 37*b* are provided, the sanitary cleaning apparatus is sanitary for cleaning the female private parts in particular. In addition, a suitable jet flow can be selected depending on health condition, age, seating position or the like.

Figure 18:
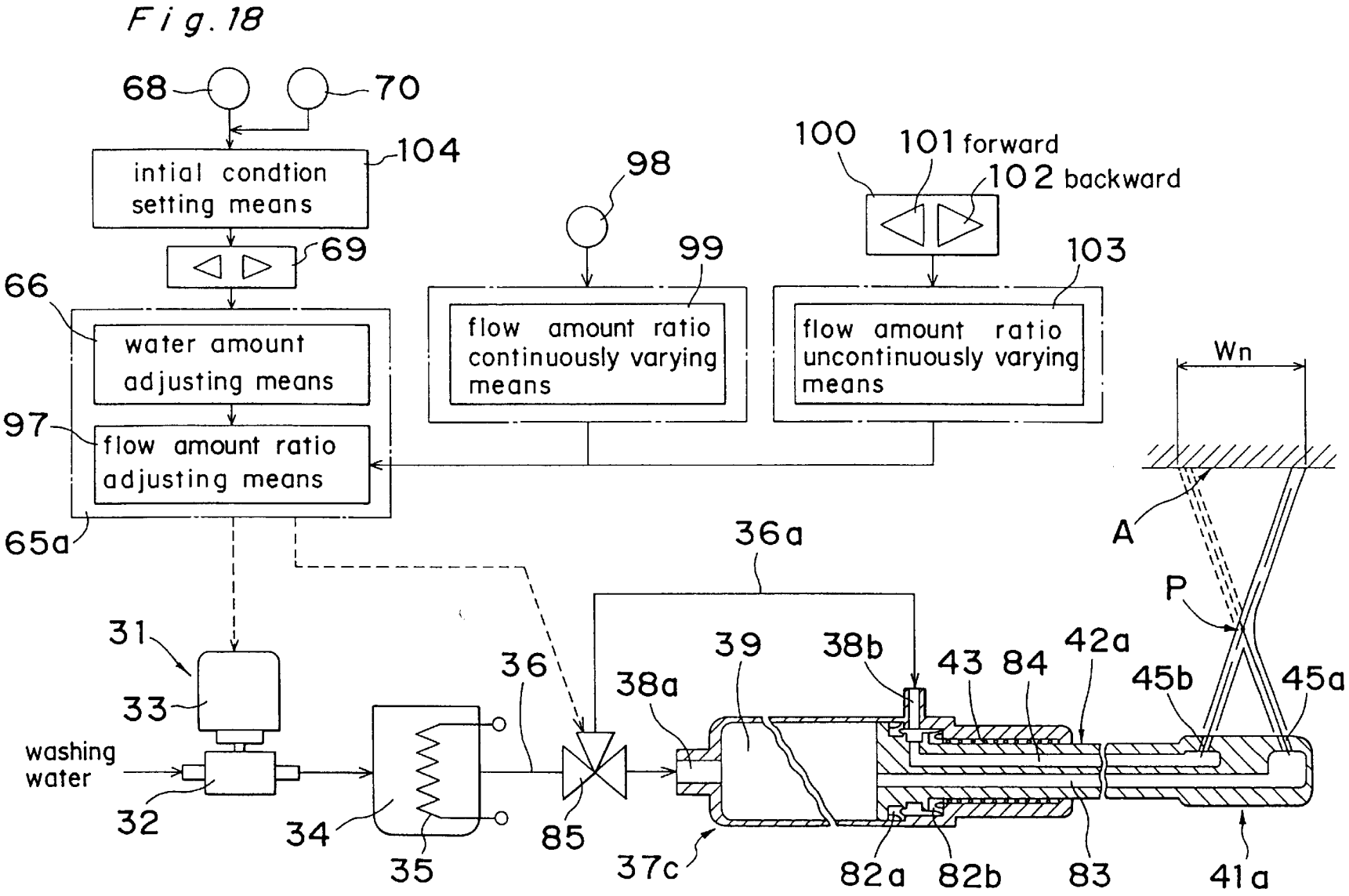
FIG. 18 is a view showing the construction of a sanitary cleaning apparatus according to a fourth embodiment of the present invention.

A sanitary cleaning apparatus according to a fourth embodiment of the present invention is described below with reference to FIG. 18. The sanitary cleaning apparatus comprises a cleaning water supply means 31 having a water pump 32 and a motor 33 for driving the pump 32; a hot water tank 34 for storing water heated by an electric heater 35; and a water supply channel 36. A nozzle main body 37*c* comprises a nozzle cylinder 39 having a first water supply opening 38*a* and a second water supply opening 38*b*; and a movable water supply member 42*a* disposed inside the nozzle cylinder 39 and driven to move forward by the water pressure of cleaning water to a position corresponding to the private parts (A), thus supplying the cleaning water to a cleaning nozzle 41*a* disposed at the leading end of the sanitary cleaning apparatus. The movable water supply member 42*a* comprises valves 82*a* and 82*b* for preventing the cleaning water from leaking to the outside of the nozzle 41*a* when the movable water supply member 42*a* is disposed at the jetting position; and a water supply opening 38*b* intermediate between the valves 82*a* and 82*b*. The movable water supply member 42*a* further comprises a first duct 83 which communicates with the first water supply opening 38*a* and a second duct 84 which communicates with the second water supply opening 38*b* when the movable water supply member 42*a* is disposed at the jetting position. As shown in detail in FIG. 19, the first duct 83 and the second duct 84 communicate with a first jetting opening 45*a* and a second jetting opening 45*b*, respectively. The axis of the first jetting opening 45*a* and that of the second jetting opening 45*b* intersect with each other between the upper surface 49 of the nozzle 41*a* and the private parts (A), with an angle θn formed therebetween.

Figure 20:
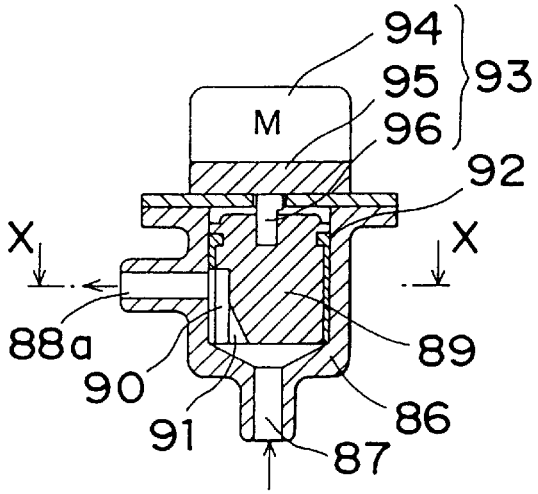
FIG. 20 is a sectional view showing a flow amount ratio control valve.
Figure 21:
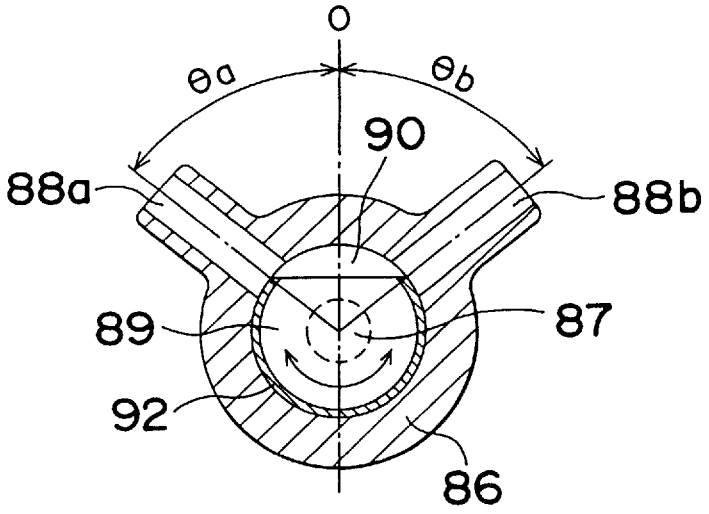
FIG. 21 is a sectional view, showing the flow ratio control valve, taken along a line X—X of FIG. 20.

A flow amount ratio control valve 85, disposed downstream of the hot water tank 34, distributes the cleaning water supplied from the cleaning water supply means 31 among the first duct 83 and the second duct 84. FIG. 20 is a sectional view showing the flow amount ratio control valve 85, and FIG. 21 is a sectional view, showing the flow amount ratio control valve 85, taken along a line X—X of FIG. 20. As shown in FIG. 20, the flow amount ratio control valve 85 comprises a housing 86 having an entrance port 87 communicating with the hot water tank 34; a first exit port 88*a*; and a second exit port 88*b* branching from the entrance port 87. The first exit port 88*a* communicates with the first water supply opening 38*a*, and the second exit port 88*b* communicate with the second water supply opening 38*b* via a bypass 36*a*. The flow amount ratio control valve 85 further comprises a valve cock 89 rotatably mounted in the housing 86; a cut-out portion 90 formed on a part of a cylinder; a path 91 communicating selectively with the first exit port 88*a* and the second exit port 88*b*; and a sealing member composed of a high polymer material containing ethylene tetrafluoride and molded integrally with the valve cock 89 by a die. The high polymer material containing ethylene tetrafluoride has a small friction coefficient and is highly elastic, thus allowing the valve cock 89 to rotate smoothly and preventing fluid from leaking to the outside. A driving means 93 for driving the valve cock 89 comprises a stepping motor 94; a decelerating means 95; and a motor shaft 96 inserted into the valve cock 89.

Figure 22:
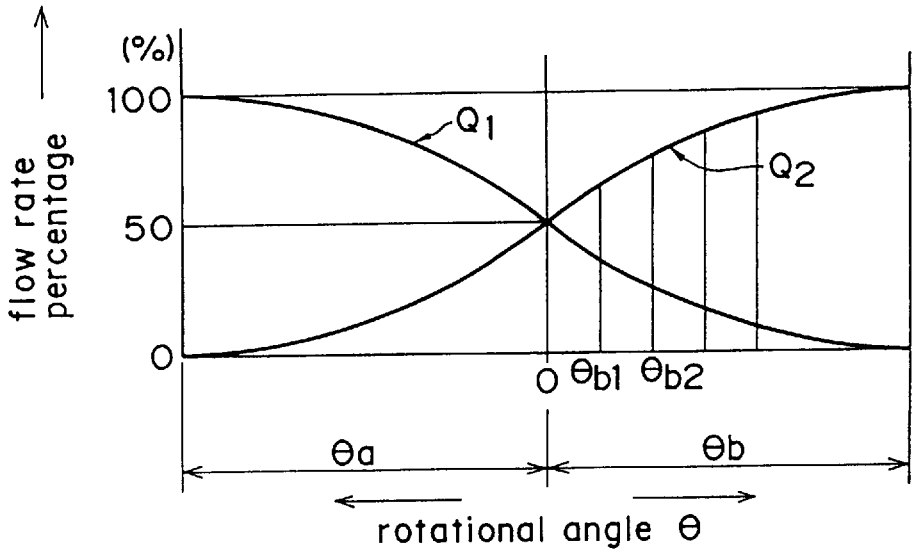
FIG. 22 is a characteristic view showing the relationship between the rotational angle of the flow ratio control valve and a flow rate.

A water supply control circuit 65*a* comprises a water amount adjusting means 66 for controlling the amount of the cleaning water by controlling the cleaning water supply means 31 upon pressing of the flow speed adjusting switch 69; and a flow amount ratio adjusting means 97 for controlling the flow amount ratio control valve 85. The flow amount ratio adjusting means 97 outputs a signal to the stepping motor 94 so as to rotate the valve cock 89 and distribute a predetermined amount of cleaning water, supplied by the cleaning water supply means 31, to the first and second ducts 83 and 84. FIG. 22 shows the relationship between the rotational angle θ of the valve cock 89 and a flow rate $Q_1$ to be distributed to the first duct 83 as well as a flow rate $Q_2$ to be distributed to the second duct 84. When the rotational angle θ is 0, an equal flow rate is distributed to the first and second exit ports 88*a* and 88*b*. When the valve cock 89 rotates toward θa side, the flow rate to be supplied to the first exit port 88*a* increases while the flow rate to be supplied to the second exit port 88*b* decreases. When the valve cock 89 rotates toward θb side, the flow rate to be supplied to the first exit port 88*a* decreases while the flow rate to be supplied to the second exit port 88*b* increases.

When a fluctuation selection switch 98 is pressed, a flow amount ratio continuously varying means 99 is actuated, thus outputting a signal to the flow amount ratio adjusting means 97. As a result, the driving means 93 rotates the valve cock 89 clockwise and counterclockwise continuously alternately in a range from θa to θb shown in FIG. 21. In this manner, the ratio of flow rate $Q_1$ to $Q_2$ is continuously increased or decreased. Each time a position adjusting switch 100 having a forward moving switch 101 and a backward moving switch 102 is pressed, a flow amount ratio uncontinuously varying means 103 is actuated, thus outputting a signal to the flow amount ratio adjusting means 97. As a result, the stepping motor 94 rotates by a predetermined angle, thus intermittently rotating the valve cock 89 in the range from θa to θb.

In a state in which a flow speed and a flow amount ratio are set according to a user's desire upon pressing of the switch 68, upon pressing of the stop switch 70, an initializing means 104 sets the flow speed adjusting means 66 to a standard flow speed, and the flow amount ratio adjusting means 97 outputs a signal indicating the return of the valve cock 89 to the position corresponding to a rotational angle 0 shown in FIG. 21. In this manner, preparation for cleaning operation is completed. Thus, upon pressing of the switch 68 again, cleaning operation starts based on an initialization.

Figure 19:
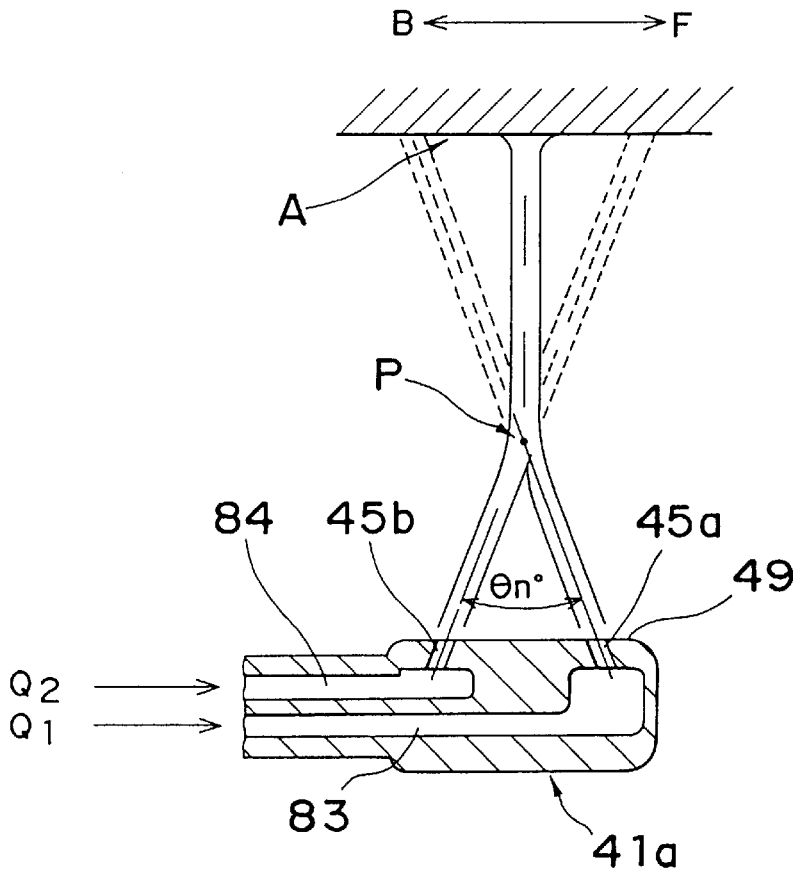
FIG. 19 is an enlarged view showing a cleaning nozzle of the sanitary cleaning apparatus of FIG. 18.

The operation of the sanitary cleaning apparatus having the above-described construction is described below. Upon pressing of the switch 68, the cleaning water supply means 31 is actuated based on the initialization set by the initializing means 104, thus supplying the cleaning water to the flow amount ratio control valve 85 via the hot water tank 34. At this time, the valve cock 89 of the flow amount ratio control valve 85 is set to the position corresponding to a rotational angle 0 as shown in FIG. 21. An equal amount of (50%) cleaning water is supplied to the first and second ducts 83 and 84 via the first and second exit ports 88*a* and 88*b*, respectively. Then, the cleaning water is jetted from the first and second jetting openings 45*a* and 45*b*. Because the first and second jetting openings 45*a* and 45*b* form an angle θn therebetween, jet flows are confluent at the point (P), thus colliding with the private parts (A) in the form of a convergent jet flow as shown by a solid line of FIG. 19. In this manner, the private parts (A) is cleaned. A flow speed can be selected depending on a user's desire by pressing the flow speed adjusting switch 69. If cleaning position is inappropriate due to a seating position or the like and so, if the user desires the jet flow to be moved forward of the user, the forward moving switch 101 of the position adjusting switch 100 is pressed. As a result, the flow amount ratio adjusting means 97 is actuated upon receipt of a signal outputted from the flow amount ratio uncontinuously varying means 103, and the valve cock 89 of the flow amount ratio control valve 85 is rotated by a predetermined angle $\theta b_1$ from the position corresponding to the rotational angle 0 toward the direction of θb as shown in FIG. 21. As a result, the flow rate $Q_1$ to be supplied to the first duct 83 decreases whereas the flow rate $Q_2$ to be supplied to the second duct 84 increases. Consequently, as shown in FIG. 19, the jet force from the second jetting opening 45*b* increases, with the result that the jet flow moves to the direction shown by an arrow F, i.e., the jet flow moves to a position forward of the user. If the user wants the cleaning water to be jetted forward of the position shown in FIG. 21, the forward moving switch 101 is pressed again to rotate the valve cock 89 by an angle θb2. If the user desires the cleaning water to be jetted in a backward position, the backward moving switch 102 is selected. In this manner, the cleaning position can be adjusted stepwise.

The operation of the flow amount ratio continuously varying means 99 is described below. When the fluctuation selection switch 98 is pressed after the switch 68 is turned on, the flow amount ratio continuously varying means 99 is actuated, thus outputting a signal to the flow amount ratio adjusting means 97. Then, the valve cock 89 of the flow amount ratio control valve 85 is rotated in both ways continuously alternately in the range from the θa to the θb shown in FIG. 21. In this manner, the ratio of flow rate $Q_1$ to $Q_2$ is continuously increased or decreased. As a result, the cleaning water jetted from the first and second jetting openings 45*a* and 45*b* increases and decreases alternately and successively. When the flow rate $Q_1$ increases, the cleaning position moves to the direction shown by the arrow (B) of FIG. 19, whereas when the flow rate $Q_2$ increases, the cleaning position moves to the direction shown by the arrow (F) of FIG. 19. In this manner, the user can have the region widely cleaned by the fluctuant jet flow. The range Wn of the jet flow is proportional to the inclination θn of the first and second jetting openings 45*a* and 45*b*. That is, when the inclination θn is set to be large, the range Wn, namely, the cleaning position adjusting range can be set to be large. The fluctuation cycle depends on the operation speed of the flow amount ratio control valve 85, namely, the rotational speed of the stepping motor 94 and the reduction ratio of the decelerating means 95 when the fluctuant cleaning water is selected.

As described above, the cleaning water according to this embodiment comprises the first and second jetting openings 45*a* and 45*b* inclined by a predetermined angle with respect to the jetting direction so as to allow jet flows to be in confluence and contact with each other; the two ducts 83 and 84 provided in correspondence with each of the first and second jetting openings 45*a* and 45*b*; and the flow amount ratio control valve 85 for controlling the ratio of the flow amount to be supplied to the two ducts 83 and 84. When the ratio of the flow amount to be jetted from the first jetting opening 45*a* to the flow amount to be jetted from the second jetting opening 45*b* is controlled to be 1:1, the cleaning water is jetted convergently. When the fluctuation selection switch 98 is selected, the cleaning water jetted from the first and second jetting openings 45*a* and 45*b* increases and decreases alternately and successively. In this manner, the cleaning water can be jetted fluctuantly in a wide range over the region to be cleaned. Therefore, the user can select a jet flow according to the user's health condition, age, seating position or desire.

In addition, it is possible to adjust the ratio of the flow amount between the first and second jetting openings 45*a* and 45*b* stepwise by pressing the position adjusting switch 100. Thus, the cleaning position can be adjusted without moving the nozzle main body 37*c*. This construction allows the sanitary cleaning apparatus to be simple and cost to be inexpensive and further, reliability to be improved.

Further, the initializing means 104 enables the user to change the flow speed and cleaning position previously set, according to the user's desire. Hence, unnecessary switch pressing operation is eliminated. Considering that a plurality of persons uses the sanitary cleaning apparatus, this mechanism is very convenient.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

What is claimed is:

1. A sanitary cleaning apparatus comprising:

a cleaning water supply device;

a water supply channel fluidically connected to said cleaning water supply device;

a cleaning nozzle fluidically connected to said water supply channel for jetting cleaning water toward a region to be cleaned;

an air mixing device fluidically connected to said cleaning nozzle for mixing air with the cleaning water;

a first jet flow selection switch for selectively controlling said air mixing device to either supply air into a flow of cleaning water flowing into said cleaning nozzle or to stop supplying air into the flow of cleaning water flowing into said cleaning nozzle;

wherein said cleaning nozzle comprises discharging means for discharging a dispersed jet flow when said air mixing device is controlled to supply air into the flow of cleaning water and for discharging a concentrated jet flow when said air mixing device is controlled to stop supplying air into the flow of cleaning water;

wherein said discharging means comprises a nozzle chamber fluidically connected to said water supply channel, a main jetting opening leading out of said nozzle chamber and having a first diameter, and first and second pairs of subsidiary jetting openings leading out of said nozzle chamber and being disposed relative to said main jetting opening such that said first pair of said subsidiary jetting openings is spaced from said main jetting opening by a first given distance in a first longitudinal direction of said cleaning nozzle, said second pair of said subsidiary jetting openings is spaced from said main jetting opening by a second given distance in a second longitudinal direction of said cleaning nozzle opposite said first longitudinal direction, and the openings of said first pair of said subsidiary jetting openings are spaced apart from the openings of said second pair of said subsidiary jetting openings, respectively, by equal distances, each of said subsidiary jetting openings having a second diameter smaller than said first diameter of said main jetting opening, and said subsidiary jetting openings having axes inclined so that jet flows discharged therefrom intersect with one another at a location between said cleaning nozzle and the region to be cleaned.

2. A sanitary cleaning apparatus as defined in claim 1, further comprising a second jet flow selection switch, and a swinging control means for altering the amount of air to be mixed in the cleaning water in a predetermined cycle in accordance with a signal transmitted from said second jet flow selection switch, whereby dispersed jet flows and concentrated jet flows can be repeatedly discharged alternately by a predetermined cycle.

3. A sanitary cleaning apparatus as defined in claim 2, further comprising a flow speed adjusting switch for adjusting the flow speed of the cleaning water; and an air adjust boundary setting means for setting upper and lower limits of an air amount increased or decreased by said swinging control means, according to the flow speed selected by the flow speed adjusting switch.

4. A sanitary cleaning apparatus as defined in claim 3, wherein an air-mixed cleaning mode is initially selected upon starting of the cleaning.

5. A sanitary cleaning apparatus as defined in claim 2, wherein an air-mixed cleaning mode is initially selected upon starting of the cleaning.

6. A sanitary cleaning apparatus as defined in claim 1, wherein an air-mixed cleaning mode is initially selected upon starting of the cleaning.

7. A sanitary cleaning apparatus as defined in claim 1, wherein the air mixing device comprises an air pump for generating compressed air, and an air supply pipe for mixing the compressed air in the cleaning water.

8. A sanitary cleaning apparatus as defined in claim 1, further comprising an air mixing stopping means for controlling the air mixing device in accordance with a signal transmitted from said first jet flow selection switch.

9. A sanitary cleaning apparatus as defined in claim 8, further comprising water amount increasing means for increasing a predetermined amount of cleaning water by controlling the cleaning water supply device when a cleaning mode in which air is not mixed with the cleaning water is selected by the actuation of said first jet flow selection switch.

10. A sanitary cleaning apparatus as defined in claim 9, wherein an air-mixed cleaning mode is initially selected upon starting of the cleaning.

11. A sanitary cleaning apparatus comprising:

a cleaning water supply device;

a water supply channel fluidically connected to said cleaning water supply device;

a cleaning nozzle fluidically connected to said water supply channel;

an air mixing device fluidically connected to said cleaning nozzle;

a first jet flow selection switch for selectively controlling said air mixing device to either supply air into a flow of cleaning water flowing into said cleaning nozzle or to stop supplying air into the flow of cleaning water flowing into said cleaning nozzle;

wherein said cleaning nozzle comprises a nozzle chamber fluidically connected to said water supply channel, a main jetting opening leading out of said nozzle chamber and having a first diameter, and a plurality of peripheral jetting openings leading out of said nozzle chamber and being disposed about a periphery of said main jetting opening, each of said peripheral jetting openings having a second diameter smaller than said first diameter of said main jetting opening;

wherein said peripheral jetting openings have axes inclined so that jet flows discharged therefrom intersect with one another, whereby said main jetting opening and said peripheral jetting openings together constitute means for discharging a dispersed jet flow when said air mixing device is controlled to supply air into the flow of cleaning water and for discharging a concentrated jet flow when said air mixing device is controlled to stop supplying air into the flow of cleaning water; and wherein said air mixing device comprises an air pump for generating compressed air, and an air supply pipe provided to coaxially extend into a nozzle cylinder which communicates with the cleaning nozzle for mixing the compressed air into the cleaning water.

* * * * *